US008942398B2

(12) United States Patent
Salvetti et al.

(10) Patent No.: US 8,942,398 B2
(45) Date of Patent: Jan. 27, 2015

(54) METHODS AND APPARATUS FOR EARLY AUDIO FEEDBACK CANCELLATION FOR HEARING ASSISTANCE DEVICES

(75) Inventors: Arthur Salvetti, Colorado Springs, CO (US); Harikrishna P. Natarajan, Shakopee, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 86 days.

(21) Appl. No.: 13/085,042

(22) Filed: Apr. 12, 2011

(65) Prior Publication Data

US 2011/0249847 A1 Oct. 13, 2011

Related U.S. Application Data

(60) Provisional application No. 61/323,542, filed on Apr. 13, 2010.

(51) Int. Cl.
*H04R 25/00* (2006.01)

(52) U.S. Cl.
USPC ..... 381/318

(58) Field of Classification Search
USPC ..... 381/318
See application file for complete search history.

(56) References Cited

U.S. PATENT DOCUMENTS

| | | | |
|---|---|---|---|
| 3,601,549 | A | 8/1971 | Mitchell |
| 3,803,357 | A | 4/1974 | Sacks |
| 3,995,124 | A | 11/1976 | Gabr |
| 4,025,721 | A | 5/1977 | Graupe et al. |
| 4,038,536 | A | 7/1977 | Feintuch |
| 4,052,559 | A | 10/1977 | Paul et al. |
| 4,088,834 | A | 5/1978 | Thurmond |
| 4,122,303 | A | 10/1978 | Chaplin et al. |
| 4,130,726 | A | 12/1978 | Kates et al. |
| 4,131,760 | A | 12/1978 | Christensen et al. |
| 4,176,252 | A | 11/1979 | Dutkovich |
| 4,185,168 | A | 1/1980 | Graupe et al. |

(Continued)

FOREIGN PATENT DOCUMENTS

| | | |
|---|---|---|
| CH | 653508 | 12/1985 |
| DE | 19748079 A1 | 5/1999 |

(Continued)

OTHER PUBLICATIONS

"U.S. Appl. No. 11/276,763, Notice of Allowance mailed Oct. 11, 2011", 8 pgs.

(Continued)

*Primary Examiner* — Brian Ensey
*Assistant Examiner* — Katherine Faley
(74) *Attorney, Agent, or Firm* — Schwegman Lundberg & Woessner, P.A.

(57) ABSTRACT

Disclosed herein, among other things, are methods and apparatus for improved feedback cancellation for hearing assistance devices. In various embodiments the present acoustic feedback cancellation system is configured to identify the onset of acoustic feedback. This early detection is accomplished in a variety of ways, including detection of an exponential rise in a periodic signal which is associated with early acoustic feedback. The present system is very rapid and so it can operate when the conditions surrounding the hearing aid change quickly. It also is useful to not impose feedback cancellation to longer notes that will "fool" less sophisticated acoustic feedback cancellers into thinking the sound is feedback.

20 Claims, 6 Drawing Sheets

(56) References Cited

U.S. PATENT DOCUMENTS

| | | | | |
|---|---|---|---|---|
| 4,187,413 | A | 2/1980 | Moser | |
| 4,188,667 | A | 2/1980 | Graupe et al. | |
| 4,232,192 | A | 11/1980 | Beex | |
| 4,238,746 | A | 12/1980 | Chabries et al. | |
| 4,243,935 | A | 1/1981 | McCool et al. | |
| 4,366,349 | A | 12/1982 | Adelman | |
| 4,377,793 | A | 3/1983 | Horna | |
| 4,425,481 | A | 1/1984 | Mansgold et al. | |
| 4,471,171 | A | 9/1984 | Kopke et al. | |
| 4,485,272 | A | 11/1984 | Duong et al. | |
| 4,508,940 | A | 4/1985 | Steeger | |
| 4,548,082 | A | 10/1985 | Engebretson et al. | |
| 4,582,963 | A | 4/1986 | Danstrom | |
| 4,589,137 | A | 5/1986 | Miller | |
| 4,596,902 | A | 6/1986 | Gilman | |
| 4,622,440 | A | 11/1986 | Slavin | |
| 4,628,529 | A | 12/1986 | Borth et al. | |
| 4,630,305 | A | 12/1986 | Borth et al. | |
| 4,658,426 | A | 4/1987 | Chabries et al. | |
| 4,680,798 | A | 7/1987 | Neumann | |
| 4,731,850 | A | 3/1988 | Levitt et al. | |
| 4,751,738 | A | 6/1988 | Widrow et al. | |
| 4,771,396 | A | 9/1988 | South et al. | |
| 4,783,817 | A | 11/1988 | Hamada et al. | |
| 4,783,818 | A | 11/1988 | Graupe et al. | |
| 4,791,672 | A | 12/1988 | Nunley et al. | |
| 4,823,382 | A | 4/1989 | Martinez | |
| 4,879,749 | A | 11/1989 | Levitt et al. | |
| 4,972,482 | A | 11/1990 | Ishiguro et al. | |
| 4,972,487 | A | 11/1990 | Mangold et al. | |
| 4,989,251 | A | 1/1991 | Mangold | |
| 5,016,280 | A | 5/1991 | Engebretson et al. | |
| 5,091,952 | A | 2/1992 | Williamson et al. | |
| 5,170,434 | A | 12/1992 | Anderson | |
| 5,259,033 | A | 11/1993 | Goodings et al. | |
| 5,502,869 | A | 4/1996 | Smith et al. | |
| 5,533,120 | A | 7/1996 | Staudacher | |
| 5,606,620 | A | 2/1997 | Weinfurtner | |
| 5,619,580 | A | 4/1997 | Hansen | |
| 5,621,802 | A | 4/1997 | Harjani et al. | |
| 5,668,747 | A | 9/1997 | Ohashi | |
| 5,737,410 | A | 4/1998 | Vahatalo et al. | |
| 5,838,806 | A | 11/1998 | Sigwanz et al. | |
| 5,920,548 | A | 7/1999 | El Malki | |
| 5,987,146 | A | 11/1999 | Pluvinage et al. | |
| 5,991,419 | A | 11/1999 | Brander | |
| 6,035,050 | A | 3/2000 | Weinfurtner et al. | |
| 6,044,183 | A | 3/2000 | Pryor | |
| 6,104,993 | A * | 8/2000 | Ashley | 704/227 |
| 6,173,063 | B1 | 1/2001 | Melanson | |
| 6,219,427 | B1 | 4/2001 | Kates et al. | |
| 6,240,192 | B1 | 5/2001 | Brennan et al. | |
| 6,275,596 | B1 | 8/2001 | Fretz et al. | |
| 6,389,440 | B1 | 5/2002 | Lewis et al. | |
| 6,434,247 | B1 | 8/2002 | Kates et al. | |
| 6,480,610 | B1 | 11/2002 | Fang et al. | |
| 6,498,858 | B2 | 12/2002 | Kates | |
| 6,552,446 | B1 | 4/2003 | Lomba et al. | |
| 6,876,751 | B1 | 4/2005 | Gao et al. | |
| 6,882,736 | B2 * | 4/2005 | Dickel et al. | 381/317 |
| 6,928,160 | B2 | 8/2005 | Ebenezer et al. | |
| 7,058,182 | B2 | 6/2006 | Kates | |
| 7,068,802 | B2 | 6/2006 | Schulz et al. | |
| 7,088,835 | B1 | 8/2006 | Norris et al. | |
| 7,155,018 | B1 | 12/2006 | Stokes, III et al. | |
| 7,292,699 | B2 | 11/2007 | Gao et al. | |
| 7,386,142 | B2 | 6/2008 | Kindred | |
| 7,519,193 | B2 | 4/2009 | Fretz | |
| 7,809,150 | B2 | 10/2010 | Natarajan et al. | |
| 7,889,879 | B2 | 2/2011 | Dillon et al. | |
| 7,945,066 | B2 | 5/2011 | Kindred | |
| 7,986,790 | B2 | 7/2011 | Zhang et al. | |
| 8,116,473 | B2 | 2/2012 | Salvetti et al. | |
| 8,553,899 | B2 | 10/2013 | Salvetti et al. | |
| 8,571,244 | B2 | 10/2013 | Salvetti | |
| 8,634,576 | B2 | 1/2014 | Salvetti et al. | |
| 2001/0002930 | A1 | 6/2001 | Kates | |
| 2002/0025055 | A1 | 2/2002 | Stonikas et al. | |
| 2002/0051546 | A1 | 5/2002 | Bizjak | |
| 2002/0057814 | A1 | 5/2002 | Kaulberg | |
| 2002/0176584 | A1 | 11/2002 | Kates | |
| 2003/0026442 | A1 | 2/2003 | Fang et al. | |
| 2004/0086137 | A1 | 5/2004 | Yu et al. | |
| 2004/0125973 | A1 | 7/2004 | Fang et al. | |
| 2004/0136557 | A1 | 7/2004 | Kaulberg | |
| 2004/0190739 | A1 | 9/2004 | Bachler et al. | |
| 2004/0218772 | A1 | 11/2004 | Ryan | |
| 2005/0036632 | A1 | 2/2005 | Natarajan et al. | |
| 2005/0047620 | A1 | 3/2005 | Fretz | |
| 2005/0265568 | A1 | 12/2005 | Kindred | |
| 2006/0173259 | A1 | 8/2006 | Flaherty et al. | |
| 2007/0036280 | A1 | 2/2007 | Roeck et al. | |
| 2007/0217620 | A1 | 9/2007 | Zhang et al. | |
| 2007/0223755 | A1 | 9/2007 | Salvetti et al. | |
| 2007/0280487 | A1 | 12/2007 | Ura et al. | |
| 2008/0063228 | A1 * | 3/2008 | Mejia et al. | 381/318 |
| 2008/0130927 | A1 * | 6/2008 | Theverapperuma et al. | 381/318 |
| 2008/0304684 | A1 | 12/2008 | Kindred | |
| 2009/0175474 | A1 | 7/2009 | Salvetti et al. | |
| 2009/0245552 | A1 | 10/2009 | Salvetti | |
| 2010/0111339 | A1 * | 5/2010 | Sira | 381/318 |
| 2011/0091049 | A1 | 4/2011 | Salvetti et al. | |
| 2011/0116667 | A1 | 5/2011 | Natarajan et al. | |
| 2011/0150231 | A1 | 6/2011 | Natarajan | |
| 2011/0249846 | A1 | 10/2011 | Natarajan | |
| 2014/0098967 | A1 | 4/2014 | Salvetti et al. | |

FOREIGN PATENT DOCUMENTS

| | | | |
|---|---|---|---|
| EP | 250679 | A2 | 1/1988 |
| EP | 250679 | B1 | 7/1993 |
| EP | 712263 | A1 | 1/2003 |
| EP | 712263 | B1 | 1/2003 |
| EP | 1538868 | A2 | 6/2005 |
| EP | 1624719 | A2 | 2/2006 |
| EP | 1718110 | A1 | 2/2006 |
| EP | 1708543 | A1 | 10/2006 |
| EP | 1835784 | A1 | 9/2007 |
| EP | 2106163 | B1 | 3/2013 |
| GB | 1356645 | | 6/1974 |
| JP | 59-64994 | | 4/1984 |
| JP | 60-31315 | | 2/1985 |
| WO | WO-0106746 | A2 | 1/2001 |
| WO | WO-0154456 | A1 | 7/2001 |
| WO | WO-03098970 | A1 | 11/2003 |
| WO | WO-2004105430 | A1 | 12/2004 |
| WO | WO-2009068028 | A1 | 6/2009 |
| WO | WO-2009124550 | A1 | 10/2009 |

OTHER PUBLICATIONS

"U.S. Appl. No. 12/336,460, Non Final Office Action mailed Sep. 29, 2011", 13 pgs.

"U.S. Appl. No. 12/336,460, Response filed Jan. 30, 2012 to Non Final Office Action mailed Sep. 29, 2011", 25 pgs.

"U.S. Appl. No. 12/336,460, Response filed Jan. 30, 2012 to Non Final Office Action mailed Sep. 29, 2011", 15 pgs.

"U.S. Appl. No. 12/644,932, Non Final Office Action mailed Dec. 29, 2011", 14 pgs.

"U.S. Appl. No. 12/875,646, Non Final Office Action mailed Jan. 30, 2012", 4 pgs.

"U.S. Appl. No. 11/276,763, Notice of Allowance mailed Aug. 25, 2011", 8 pgs.

"U.S. Appl. No. 12/408,928, Non Final Office Action mailed Aug. 4, 2011", 25 pgs.

"Advance Adaptive Feedback Cancellation", IntriCon: Technology White Paper, [Online]. Retrieved from the Internet: <URL: http://www.intricondownloads.com/D1/techdemo/WP_Advanced_AFC_rev101006.pdf>, (Oct. 10, 2005), 3 pgs.

"U.S. Appl. No. 10/854,922, Non Final Office Action mailed Sep. 5, 2006", 13 pgs.

"U.S. Appl. No. 10/854,922, Notice of Allowance mailed May 22, 2007", 7 pgs.

(56) References Cited

OTHER PUBLICATIONS

"U.S. Appl. No. 10/854,922, Notice of Allowance mailed Nov. 19, 2007", 9 pgs.
"U.S. Appl. No. 10/854,922, Response filed Mar. 5, 2007 to Non Final Office Action mailed Sep. 5, 2006", 12 pgs.
"U.S. Appl. No. 10/857,599, Final Office Action mailed Jun. 11, 2009", 7 pgs.
"U.S. Appl. No. 10/857,599, Final Office Action Mailed Jul. 24, 2008", 9 pgs.
"U.S. Appl. No. 10/857,599, Non-Final Office Action mailed Jan. 26, 2010", 8 pgs.
"U.S. Appl. No. 10/857,599, Non-Final Office Action mailed Dec. 26, 2007", 8 pgs.
"U.S. Appl. No. 10/857,599, Non-Final Office Action mailed Dec. 31, 2008", 6 pgs.
"U.S. Appl. No. 10/857,599, Notice of Allowance mailed Jul. 26, 2010", 10 pgs.
"U.S. Appl. No. 10/857,599, Response filed Apr. 26, 2010 to Non Final Office Action mailed Jan. 26, 2010", 8 pgs.
"U.S. Appl. No. 10/857,599, Response filed Apr. 28, 2008 to Non-Final Office Action mailed Dec. 26, 2007", 7 pgs.
"U.S. Appl. No. 10/857,599, Response filed Apr. 30, 2009 to Non-Final Office Action mailed Dec. 31, 2008", 7 pgs.
"U.S. Appl. No. 10/857,599, Response filed Nov. 12, 2009 to Final Office Action mailed Jun. 11, 2009", 9 pgs.
"U.S. Appl. No. 10/857,599, Response filed Nov. 16, 2007 to Restriction Requirement dated May 21, 2007", 6 pgs.
"U.S. Appl. No. 10/857,599, Response filed Nov. 24, 2008 to Final Office Action mailed Jul. 24, 2008", 9 pgs.
"U.S. Appl. No. 10/857,599, Restriction Requirement mailed May 21, 2007", 5 pgs.
"U.S. Appl. No. 11/276,763, Decision on Pre-Appeal Brief Request mailed Feb. 15, 2011", 3 pgs.
"U.S. Appl. No. 11/276,763, Final Office Action mailed Sep. 14, 2010", 9 pgs.
"U.S. Appl. No. 11/276,763, Non-Final Office Action mailed Apr. 2, 2010", 11 pgs.
"U.S. Appl. No. 11/276,763, Pre-Appeal Brief Request filed Jan. 14, 2011", 5 pgs.
"U.S. Appl. No. 11/276,763, Response filed Jan. 11, 2010 to Restriction Requirement mailed Dec. 10, 2009", 9 pgs.
"U.S. Appl. No. 11/276,763, Response filed Jun. 15, 2011 to Final Office Action mailed Sep. 14, 2010", 10 pgs.
"U.S. Appl. No. 11/276,763, Response filed Jul. 2, 2010 to Non Final Office Action mailed Apr. 2, 2010", 15 pgs.
"U.S. Appl. No. 11/276,763, Restriction Requirement mailed Dec. 10, 2009", 6 pgs.
"U.S. Appl. No. 12/135,856 Non-Final Office Action mailed Sep. 23, 2010", 8 Pgs.
"U.S. Appl. No. 12/135,856, Notice of Allowance mailed Mar. 11, 2011", 9 pgs.
"U.S. Appl. No. 12/135,856, Response filed Dec. 23, 2010 to Non Final Office Action mailed Sep. 23, 2010", 10 pgs.
"U.S. Appl. No. 12/408,928, Preliminary Amendment mailed Jun. 24, 2009", 3 pgs.
"Entrainment (Physics)", [Online]. Retrieved from the Internet: <URL: http://en.wikipedia.org/w/index.php?title=Entrainment_(physics)&printable=yes>, (Apr. 25, 2009), 2 pgs.
"European Application Serial No. 07250899.7, European Search Report mailed May 15, 2008", 7 pgs.
"European Application Serial No. 07250899.7, Office Action Mailed Jan. 15, 2009", 1 pgs.
"European Application Serial No. 07250899.7, Office Action mailed Mar. 21, 2011", 3 pgs.
"European Application Serial No. 07250899.7, Response to Official Communication Filed Jul. 13, 2009", 17 pgs.
"European Application Serial No. 09250817.5, Extended European Search Report mailed Nov. 18, 2010", 7 pgs.
"Inspiria Ultimate—GA3285", [Online]. Retrieved from the Internet: <URL: http://www.sounddesigntechnologies.com/products_InspiriaUltimate.php>, (Jun. 18, 2009), 4 pgs.
Anderson, D. B., "Noise Reduction in Speech Signals Using Pre-Whitening and the Leaky Weight Adaptive Line Enhancer", (Project Report presented to the Department of Electrical Engineering, Brigham Young University), (Feb. 1981), 56 pgs.
Best, L. C., "Digital Suppression of Acoustic Feedback in Hearing Aids", Thesis, Department of Electrical Engineering and the Graduate School of the University of Wyoming, (May 1985), 66 pgs.
Boll, Steven F., "Suppression of Acoustic Noise in Speech Using Spectral Subtraction", IEEE Transactions on Acoustics, Speech, and Signal Processing, vol. ASSP-27, (Apr. 1979), 113-120.
Bustamante, D. K., et al., "Measurement and Adaptive Suppression of Acoustic Feedback in Hearing Aids", 1989 International Conference on Acoustics, Speech, and Signal Processing, 1989. ICASSP-89., (1989), 2017-2020.
Chabries, D. M., et al., "A General Frequency-Domain LMS Adaptive Algorithm", IEEE Transactions on Acoustics, Speech, and Signal Processing, (Aug. 1984), 6 pgs.
Chazan, D., et al., "Noise Cancellation for Hearing Aids", IEEE International Conference on ICASSP '86. Acoustics, Speech, and Signal Processing,, OTI 000251-255, (Apr. 1986), 977-980.
Christiansen, R. W., "A Frequency Domain Digital Hearing Aid", 1986 IEEE ASSP Workshop on Applications of Signal Processing to Audio and Acoustics, IEEE Acoustics, Speech, and Signal Processing Society, (1986), 4 pgs.
Christiansen, R. W., et al., "Noise Reduction in Speech Using Adaptive Filtering I: Signal Processing Algorithms", Proceedings, 103rd Conference of Acoustical Society of America, (Apr. 1982), 7 pgs.
Egolf, D. P., et al., "The Hearing Aid Feedback Path: Mathematical Simulations and Experimental Verification", J. Acoust. Soc. Am., 78(5), (1985), 1576-1587.
Kaneda, Y., et al., "Noise suppression. signal processing using 2-point received signals", Electronics and Communications in Japan (Part I: Communications), 67-A(12), (1984), 1928.
Levitt, H., "A Cancellation Technique for the Amplitude and Phase Calibration of Hearing Aids and Nonconventional Transducers", Journal of Rehabilitation Research, 24(4), (1987), 261-270.
Levitt, H., et al., "A Digital Master Hearing Aid", Journal of Rehabilitation Research and Development, 23(1), (1986), 79-87.
Levitt, H., et al., "A Historical Perspective on Digital Hearing Aids: How Digital Technology Has Changed Modern Hearing Aids", Trends in Amplification, 11(1), (Mar. 2007), 7-24.
Levitt, H., "Technology and the Education of the Hearing Impaired", Chapt. 6: Education of the Hearing Impaired Child, College-Hill Press, (Mar. 1985).
Maxwell, J. A., et al., "Reducing Acoustic Feedback in Hearing Aids", IEEE Transactions on Speech and Audio Processing, 3(4), (Jul. 1995), 304-313.
Mcaulay, R., et al., "Speech enhancement using a soft-decision noise suppression filter", IEEE Transactions on Acoustics, Speech, and Signal Processing [see also IEEE Transactions on Signal Processing], 28(2), (Apr. 1980), 137-145.
Paul, Embree, "C algorithms for real-time DSP", Library of Congress Cataloging-In-Publication Data, Prentice Hall PTR, (1995), 98-113, 134-137, 228-233, 147.
Paul, Embree, "C++ Algorithms for Digital Signal Processing", Prentice Hall PTR, (1999), 313-320.
Preves, D. A., "Evaluation of Phase Compensation for Enhancing the Signal Processing Capabilities of Hearing Aids in Situ", Thesis, Graduate School of the University of Minnesota, (Oct. 1985), 203 pgs.
Rife, D., et al., "Transfer-Function Measurement With Maximum-Length Sequences", J. Audio Eng. Soc., 37(6), (1989), 419-444.
Rosenberger, J. R., et al., "Performance of an Adaptive Echo Canceller Operating in a Noisy, Linear, Time-Invariant Environment", The Bell System Technical Journal, 50(3), (1971), 785-813.
Saeed, V. Vaseghi, "Echo Cancellation", Advanced Digital Signal Processing and Noise Reduction, Second Edition., John Wiley & Sons, (2000), 397-404.
South, C. R., et al., "Adaptive Filters to Improve Loudspeaker Telephone", Electronics Letters,15(21), (1979), 673-674.

(56) References Cited

OTHER PUBLICATIONS

Weaver, K. A., "An Adaptive Open-Loop Estimator for the Reduction of Acoustic Feedback", Thesis, Department of Electrical Engineering and the Graduate School of the University of Wyoming, (Dec. 1984), 70 pgs.
Weaver, K. A., et al., "Electronic Cancellation of Acoustic Feedback to Increase Hearing-Aid Stability", The Journal of the Acoustical Society of America, vol. 77, Issue S1, 109th Meeting, Acoustical Society of America, (Apr. 1985), p. S105.
Widrow, B, et al., "Stationary and nonstationary learning characteristics of the LMS adaptive filter", Proceedings of the IEEE, 64(8), (Aug. 1976), 1151-1162.
Widrow, B., et al., "Adaptive Antenna Systems", Proceedings of the IEEE, 55(12), (Dec. 1967), 2143-2159.
Widrow, B., et al., "Adaptive Noise Cancelling: Principles and Applications", Proceedings of the IEEE, 63(12), (1975), 1692-1716.
Wreschner, M. S., et al., "A Microprocessor Based System for Adaptive Hearing Aids", 1985 ASEE Annual Conference Proceedings, (1985), 688-691.
"U.S. Appl. No. 12/336,460 , Response filed Jun. 27, 2012 to Final Office Action mailed Apr. 27, 2012", 10 pgs.
"U.S. Appl. No. 12/366,460, Advisory Action mailed Jul. 30, 2012", 3 pgs.
"U.S. Appl. No. 12/336,460, Final Office Action mailed Apr. 27, 2012", 8 pgs.
"U.S. Appl. No. 12/408,928, Notice of Allowance mailed May 11, 2012", 9 pgs.
"U.S. Appl. No. 12/408,928, Response filed Feb. 6, 2012 to Non Final Office Action mailed Aug. 4, 2011", 23 pgs.
"U.S. Appl. No. 12/644,932, Response filed Jun. 28, 2012 to Non Final Office Action mailed Dec. 29, 2011", 12 pgs.
"U.S. Appl. No. 12/875,646, Response filed Jul. 30, 2012 to Non Final Office Action mailed Jan. 30, 2012", 7 pgs.
Taylor, Jennifer Suzanne, "Subjective versus objective measures of daily listening environments", Independent Studies and Capstones. Paper 492. Program in Audiology and Communication Sciences, Washington University School of Medicine., http://digitalcommons.wustl.edu/pacs_capstones/492, (2007), 50 pgs.
"U.S. Appl. No. 12/336,460, Non Final Office Action mailed Nov. 26, 2012", 6 pgs.
"U.S. Appl. No. 12/336,460, Notice of Allowance mailed May 10, 2013", 9 pgs.
"U.S. Appl. No. 12/336,460, Response filed Apr. 26, 2013 to Non final Office Action mailed Nov. 26, 2012", 8 pgs.
"U.S. Appl. No. 12/336,460, Supplemental Notice of Allowability mailed Sep. 13, 2013", 2 pgs.
"U.S. Appl. No. 12/408,928, Notice of Allowance mailed Jun. 24, 2013", 10 pgs.
"U.S. Appl. No. 12/644,932, Final Office Action mailed Mar. 18, 2013", 24 pgs.
"U.S. Appl. No. 12/644,932, Response filed Sep. 13, 2013 to Final Office Action mailed Mar. 18, 2013", 12 pgs.
"U.S. Appl. No. 12/875,646, Final Office Action mailed Oct. 25, 2012", 10 pgs.
"U.S. Appl. No. 12/875,646, Non Final Office Action mailed May 10, 2013", 9 pgs.
"U.S. Appl. No. 12/875,646, Response filed Apr. 25, 2013 to Final Office Action mailed Oct. 25, 2012", 9 pgs.
"U.S. Appl. No. 12/875,646, Response filed Oct. 10, 2013 to Non Final Office Action mailed May 10, 2013", 11 pgs.
"U.S. Appl. No. 12/980, Response filed May, 14, 2013 to Non Final Office Action mailed Dec. 14, 2013", 8 pgs.
"U.S. Appl. No. 12/980,720, Non Final Office Action mailed Dec. 14, 2012", 10 pgs.
"U.S. Appl. No. 12/980,720, Notice of Allowance mailed May 29, 2013", 8 pgs.
"U.S. Appl. No. 12/980,720, Notice of Allowance mailed Sep. 11, 2013", 8 pgs.
"U.S. Appl. No. 13/085,033 , Response filed Apr. 9, 2013 to Non Final Office Action mailed Nov. 9, 2012", 8 pgs.
"U.S. Appl. No. 13/085,033, Final Office Action mailed Aug. 26, 2013", 12 pgs.
"U.S. Appl. No. 13/085,033, Non Final Office Action mailed May 2, 2013", 10 pgs.
"U.S. Appl. No. 13/085,033, Non Final Office Action mailed Nov. 9, 2012", 9 pgs.
"U.S. Appl. No. 13/085,033, Response filed Aug. 2, 2013 to Non Final Office Action mailed May 2, 2013", 8 pgs.
"U.S. Appl. No. 12/875,646, Non Final Office Action mailed Jun. 25, 2014", 10 pgs.
"U.S. Appl. No. 13/085,033, Response filed Jun. 17, 2014 to Non Final Office Action mailed Mar. 6, 2014", 9 pgs.
"U.S. Appl. No. 14/105,269, Response to Non Final Office Action mailed Mar. 13, 2014", 7 pgs.
"U.S. Appl. No. 12/408,928, Preliminary Amendment filed Jun. 22, 2011", 11 pgs.
"U.S. Appl. No. 12/875,646, Advisory Action mailed May 19, 2014", 3 pgs.
"U.S. Appl. No. 12/875,646, Final Office Action mailed Feb. 25, 2014", 10 pgs.
"U.S. Appl. No. 12/875,646, Response filed Apr. 25, 2014 to Final Office Action mailed Feb. 25, 2014", 9 pgs.
"U.S. Appl. No. 13/085,033, Advisory Action mailed Nov. 7, 2013", 3 pgs.
"U.S. Appl. No. 13/085,033, Non Final Office Action mailed Mar. 6, 2014", 12 pgs.
"U.S. Appl. No. 13/085,033, Response filed Oct. 28, 2013 to Final Office Action mailed Aug. 26, 2013", 10 pgs.
"U.S. Appl. No. 14/105,269, Non Final Office Action mailed Mar. 13, 2014", 10 pgs.
"European Application Serial No. 09250817.5, Amendment filed Jun. 22, 2011", 25 pgs.
"European Application Serial No. 10252109.3, Amendment filed Jul. 16, 2013", 18 pgs.
"European Application Serial No. 10252109.3, Extended Search Report mailed Dec. 18, 2012", 8 pgs.
"European Application Serial No. 10252109.3, Office Action mailed Jan. 21, 2013", 2 pgs.
Mueller, H. Gustav, "Data logging: It's popular, but how can this feature be used to help patients?", Hearing Journal, 60(10), (Oct. 1, 2007), 6 pgs.

* cited by examiner

ALGORITHM APPLICATION WITHIN A HEARING AID SYSTEM

NEW SIGNAL POWER = K* OLD SIGNAL POWER, K>1

EXPONENTIAL GROWTH

FEEDBACK OSCILLATION AS AN EXPONENTIAL GROWTH PROCESS

BY DETECTING THE EXPONENTIAL GROWTH OF THE POWER ENVELOPE OF THE SIGNAL, IT'S POSSIBLE TO DETECT FEEDBACK BUILDUP AT ITS VERY EARLY STAGES, EVEN BEFORE IT BECOMES AN ESTABLISHED OSCILLATION.

EARLY AUDIO FEEDBACK OSCILLATION DETECTOR FLOWCHART.

EARLY AUDIO FEEDBACK OSCILLATION DETECTOR BASED ON EXPONENTIAL GROWTH PATTERN MATCHING BLOCK DIAGRAM.

METHODS AND APPARATUS FOR EARLY AUDIO FEEDBACK CANCELLATION FOR HEARING ASSISTANCE DEVICES

CLAIM OF PRIORITY

The present application claims the benefit under 35 U.S.C. 119(e) of U.S. Provisional Patent Application Serial No. 61/323,542, filed Apr. 13, 2010, which is incorporated herein by reference in its entirety.

FIELD OF THE INVENTION

The present subject matter relates generally to signal processing for hearing assistance devices and in particular to methods and apparatus for early audio feedback cancellation for hearing assistance devices.

BACKGROUND

Modern hearing assistance devices, such as hearing aids, typically include a digital signal processor in communication with a microphone and receiver. Such designs are adapted to perform a great deal of processing on sounds received by the microphone. These designs can be highly programmable and may use specialized signal processing techniques for acoustic feedback cancellation and a host of other signal processing activities.

Some acoustic feedback cancellation schemes perform quite well, but may still have difficulty in some situations. There are at least two situations when an adaptive LMS filter may not perform enough feedback cancellation, leading to an audible artifact called a "whoop." The first situation arises from rapid changes in the acoustic feedback path. If the acoustic feedback path characteristics change too fast (by an important magnitude) the LMS adaptive filter algorithm (commonly used in feedback cancellers) might not adapt fast enough to update the cancellation filter to the new parameters to perform cancellation. During the transition period feedback might not be fully compensated, generating temporary feedback oscillation. This occurs for example when the user approaches the phone headset to his/her ear. In some cases the mistuned LMS cancellation filter might even inject some extra feedback to system.

Another situation where the adaptive LMS filter may not work properly to cancel acoustic feedback occurs where the audio system receives a periodic signal for a relatively long period of time. This is because the adaptive LMS cancellation filter is programmed to respond to the periodicity of the input signal itself instead of the feedback signal. This phenomenon may cause initial attenuation of the input signal, and in the worst case the LMS feedback canceller will actually generate feedback instead of cancelling it.

What is needed in the art is a way to correct for acoustic feedback which is robust enough to compensate for rapid changes of the acoustic feedback path and will not attenuate the input signal for relatively long periodic signal inputs.

Accordingly, there is a need in the art for methods and apparatus for improved signal processing, and in particular for improved acoustic feedback cancellation for hearing assistance devices.

SUMMARY

Disclosed herein, among other things, are methods and apparatus for improved feedback cancellation for hearing assistance devices. In various embodiments the present acoustic feedback cancellation system is configured to identify the onset of acoustic feedback. This early detection is accomplished in a variety of ways, including detection of an exponential rise in a periodic signal which is associated with early acoustic feedback. The present system is very rapid and so it can operate when the conditions surrounding the hearing aid change quickly. It also is useful to not impose feedback cancellation to longer notes that will "fool" less sophisticated acoustic feedback cancellers into thinking the sound is feedback.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Disclosed herein, among other things, are methods and apparatus for improved feedback cancellation for hearing assistance devices. In various embodiments the present acoustic feedback cancellation system is configured to identify the onset of acoustic feedback. This early detection is accomplished in a variety of ways, including detection of an exponential rise in a periodic signal which is associated with early acoustic feedback. The present system is very rapid and so it can operate when the conditions surrounding the hearing aid change quickly. It also is useful to not impose feedback cancellation to longer notes that will "fool" less sophisticated acoustic feedback cancellers into thinking the sound is feedback.

Hearing aids usually use an adaptive filter to implement a feedback canceller to eliminate acoustic and/or mechanical feedback. The adaptive filter performance is governed by a number of parameters or resources that are typically defined to optimize the performance for the desired application. The desired application in hearing aids is elimination of feedback. The feedback canceller parameters are also constrained to minimize undesired side-effects such as entrainment and other artifacts. (Entrainment is discussed in commonly owned and copending U.S. patent application Ser. No. 10/857,599, filed May 27, 2004, titled METHOD AND APPARATUS TO REDUCE ENTRAINMENT-RELATED ARTIFACTS FOR HEARING ASSISTANCE DEVICES, which is hereby incorporated by reference in its entirety. Also hereby incorporated by reference is commonly-owned U.S. Provisional Patent Application Ser. No. 60/473,844, filed May 27, 2003, titled METHOD AND APPARATUS TO REDUCE ENTRAINMENT-RELATED ARTIFACTS FOR HEARING AIDS.)

Figure 1:
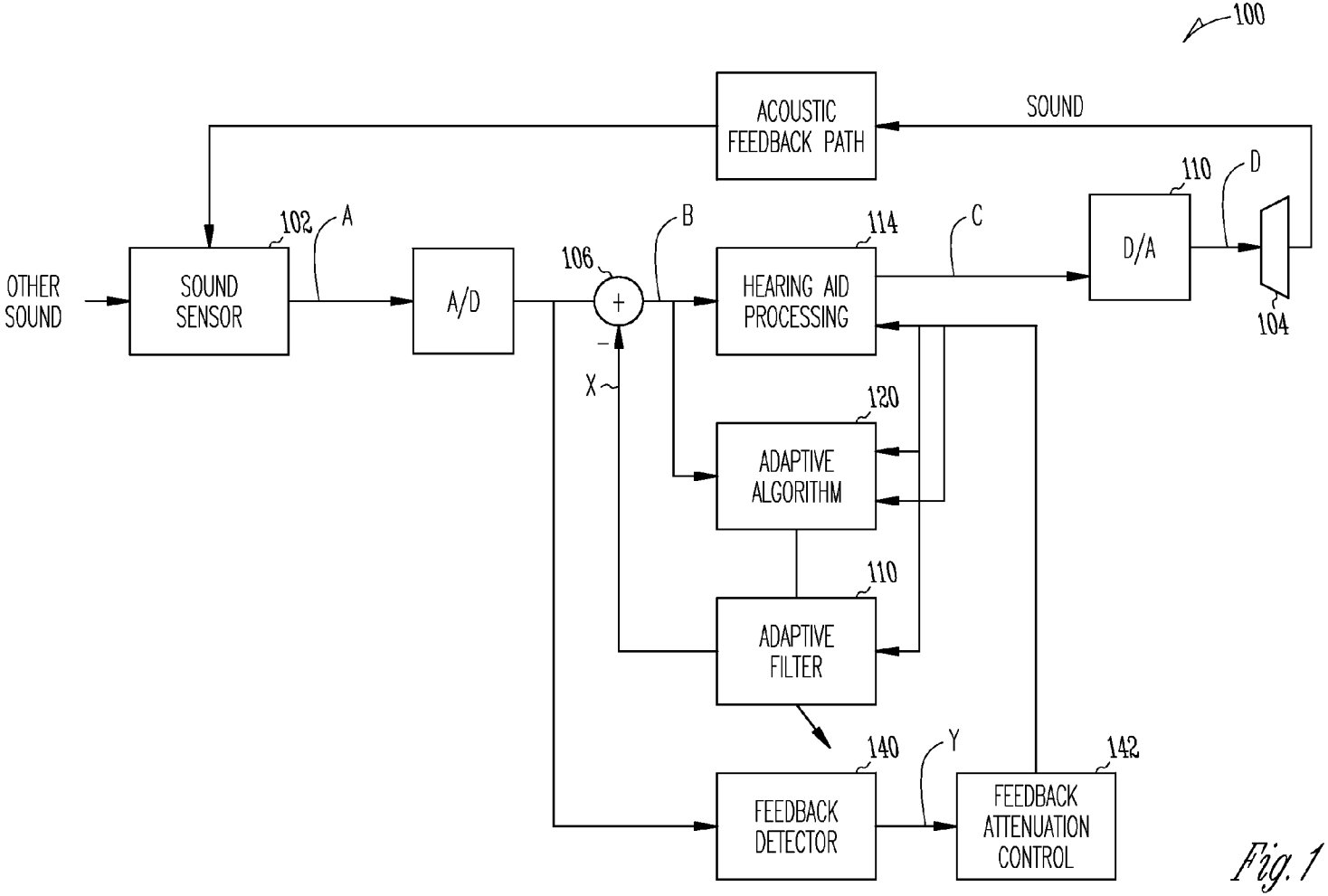
FIG. 1 shows a generalized block diagram of the present hearing assistance device system according to one embodiments of the present subject matter.

FIG. 1 shows a generalized block diagram of the present hearing assistance device system according to one embodiments of the present subject matter. The following convention is adopted: arrows to a block indicate inputs and arrows from a block are outputs and may be labeled. The hearing assistance device 100 includes a sound sensor, such as a microphone, 102 that produces a signal A which is the input to the signal processing channel of the device (which is generally all of the blocks between the input A and the output D). It is understood that the implementation of the signal processing channel can be a time domain implementation, a frequency domain implementation, a subband domain implementation, or combinations thereof. Therefore, not all individual analog-to-digital, frequency analysis, and/or time-to-frequency conversion blocks will be shown.

The output of the device D is provided to speaker 104 (also known as a receiver in the hearing aid art). Signals from the input are sent to summer 106 and subtracted from a signal X which is an output of the adaptive filter block 110.

The output of summer 106 is signal B which is provided to the gain block 114. In hearing aid applications, gain block 114 will provide programmable gain to the input signal to compensate for hearing loss. The output of the gain block is optionally fed into an output phase modulation block (not shown). The operation of the OPM block provides adjustable phase shift which includes but is not limited to the disclosure described in copending, commonly owned patent applications U.S. patent application Ser. No. 11/276,763, filed Mar. 13, 2006, titled OUTPUT PHASE MODULATION ENTRAINMENT CONTAINMENT FOR DIGITAL FILTERS and U.S. patent application Ser. No. 12/336,460, filed Dec. 16, 2008, titled OUTPUT PHASE MODULATION ENTRAINMENT CONTAINMENT FOR DIGITAL FILTERS, that are both hereby incorporated by reference in their entirety. The output of block 114 is C which is provided to receiver 104 as an analog signal D using a digital-to-analog converter (D/A). The output C is provided to the adaptive filter 110. A bulk delay may be used which provides a programmed delay and includes, but is not limited to the disclosure set forth in commonly owned U.S. Pat. No. 7,386,142, field May 27, 2004, titled METHOD AND APPARATUS FOR A HEARING ASSISTANCE SYSTEM WITH ADAPTIVE BULK DELAY, and in commonly owned and copending U.S. patent application Ser. No. 12/135,856 filed Jun. 9, 2008, titled METHOD AND APPARATUS FOR A HEARING ASSISTANCE SYSTEM WITH ADAPTIVE BULK DELAY, which are both hereby incorporated by reference in their entirety. The output C is also provided to adaptive algorithm 120 which also gets output B from summer 106.

The present system also has feedback detector 140 which receives a digital version of the input signal A and processes it to detect early acoustic feedback. The output Y of the feedback detector 140 is provided to a feedback attenuation control 142 which provides a signal to gain block 114 to implement the present early audio feedback management.

Figure 2:
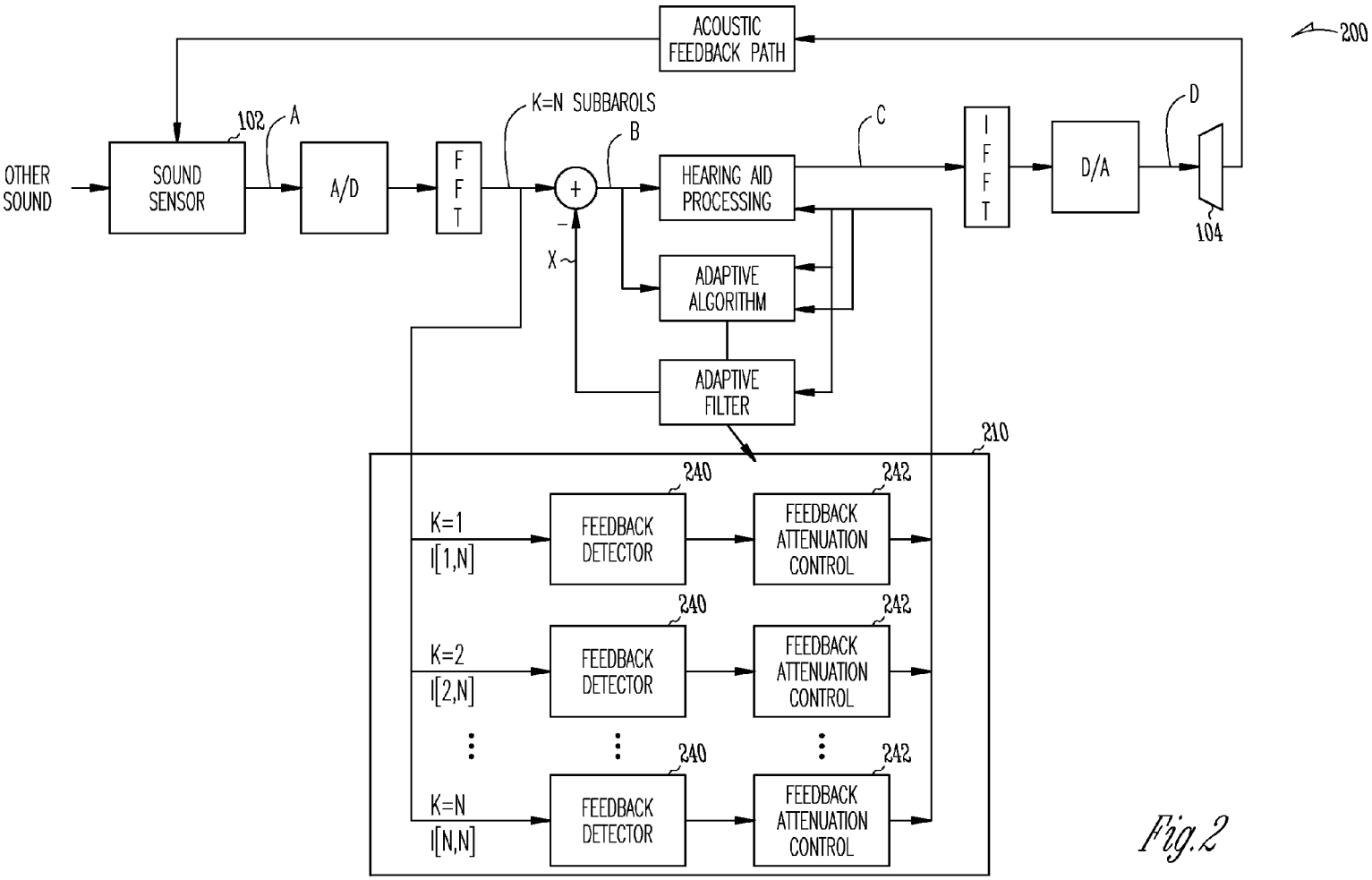
FIG. 2 shows a block diagram of a hearing assistance system using a subband approach according to one embodiment of the present subject matter.
Figure 3:
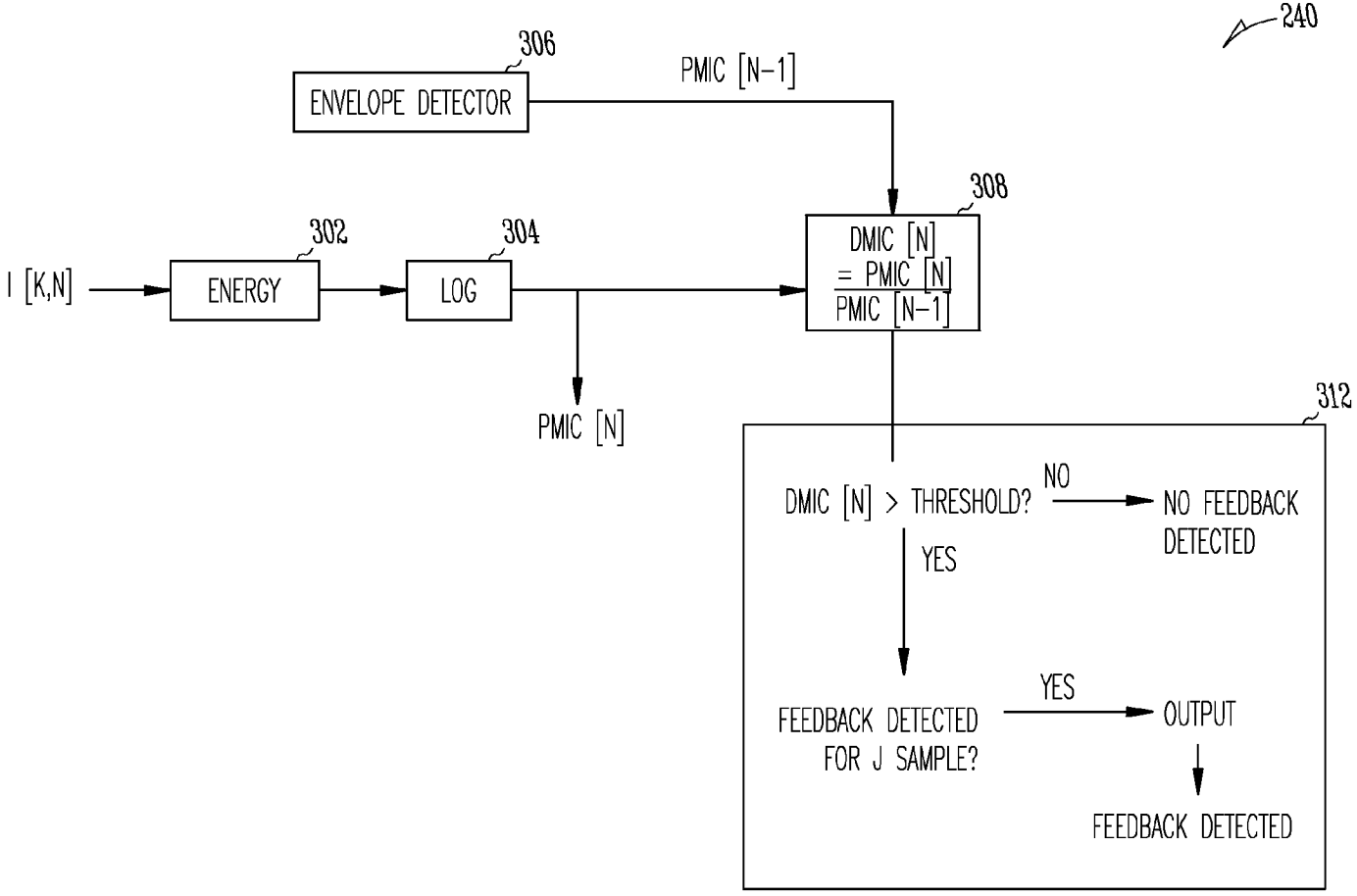
FIG. 3 shows a feedback detector block diagram according to one embodiment of the present subject matter.

In one embodiment, the feedback detector 140 is configured to detect the power envelope signal that increases exponentially. It is possible to do this detection in a subband approach, which detects the onset of acoustic feedback and also provides the subband range(s) for which it is detected so the feedback attenuation control block 142 can work to cancel the onset of acoustic feedback in each such subband. FIG. 2 shows a block diagram of a hearing assistance system 200 using a subband approach according to one embodiment of the present subject matter. This subband approach includes a frequency analysis or fast Fourier transform (FFT) block after the analog-to-digital converter. In this example, there are n subbands (each subband denoted by a number k). The various blocks operate on each of the k subbands. Block 210 is broken out to shown how the feedback detector 240 for all subbands from k=1 to N provides an output for the feedback attenuation control 242 for each of the N subbands. FIG. 1 was use to generally describe one embodiment of the system. FIG. 3 is a subband approach that otherwise operates substantially the same as FIG. 1. A frequency synthesis block denoted IFFT (for inverse FFT) is shown before the digital-to-analog converter to combine the subband information and to provide signal D.

Figure 4:
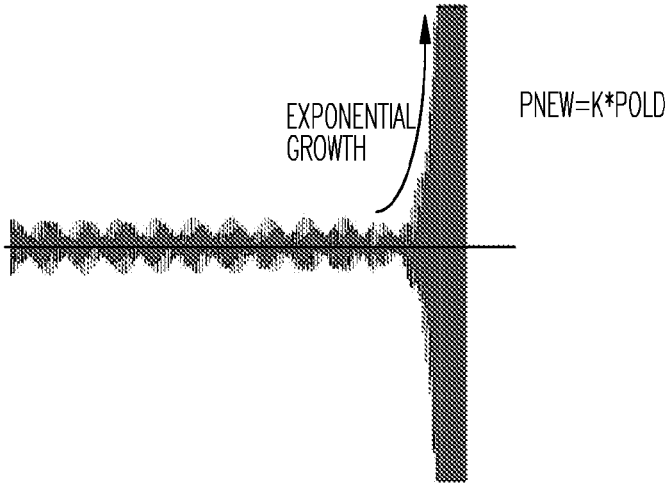
FIG. 4 shows an example of an exponential growth detected by the present system according to one embodiment.

FIG. 3 shows a feedback detector 240 block diagram according to one embodiment of the present subject matter. The input I[k,n] is a function of the particular subband k and sample n. The input is a signal indicative of a voltage that is converted into an energy in block 302. The logarithm 304 of the energy is taken to get power of the microphone signal for that subband and at sample n, (Pmic[n]). The current power sample, Pmic[n], is divided (308) by a prior power sample (Pmic[n−1]) from an envelope detector 306 to get a difference, Dmic[n]. If the difference is larger than a predetermined threshold for a predetermined amount of time (for example, for J samples) then feedback is detected. The threshold and the amount of time it must be exceeded are selected to provide an indication that an exponential increase in the power envelope has occurred. This exponential growth indicates that early feedback is taking place. FIG. 4 shows an example of an exponential growth detected by the present system according to one embodiment.

Figure 5:
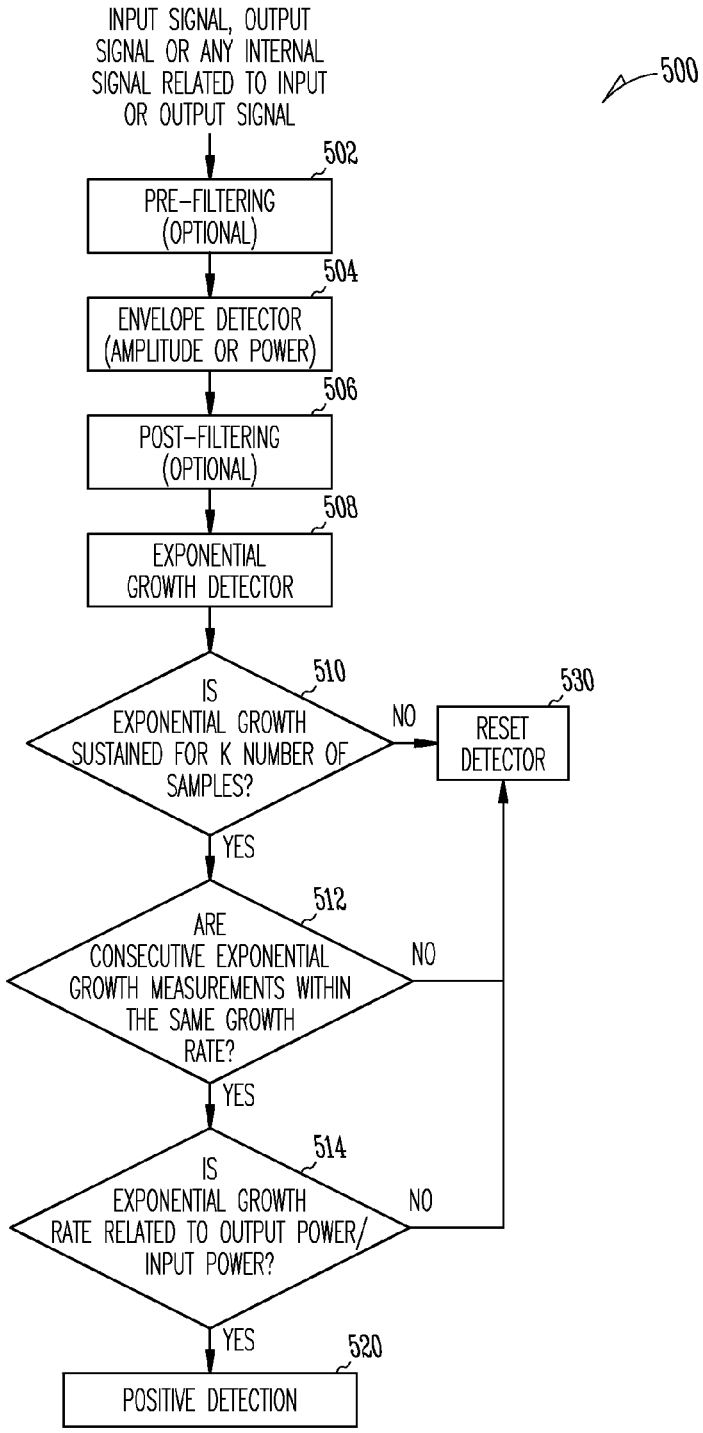
FIG. 5 shows one example of a process for early audio feedback detection according to one embodiment of the present subject matter.
Figure 6:
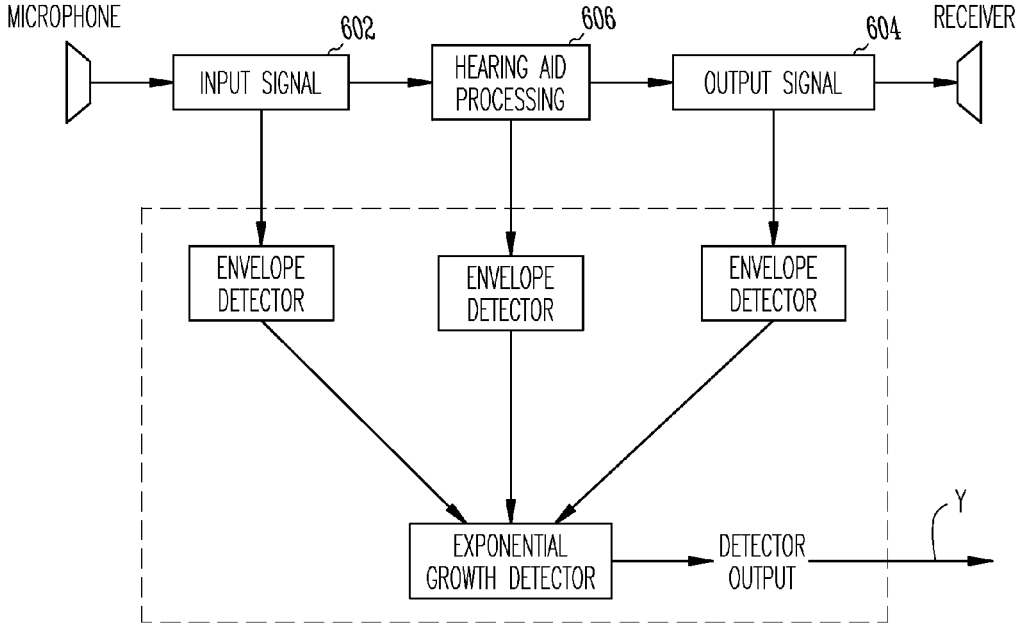
FIG. 6 is one example of an early acoustic feedback event detection process according to one embodiment of the present subject matter.

FIG. 5 shows one example of a process for early audio feedback detection according to one embodiment of the present subject matter. The process 500 may have different steps or different order of actions without departing from the teachings provided herein. This chart 500 is provided as one example of the present subject matter. The input signal can be any signal to be monitored for exponential increase. As shown in FIG. 6, the early audio feedback detection can be performed on the input signal 602, the output signal 604, or signals in the hearing aid processing channel 606 of the hearing assistance device.

The signal to be monitored may be pre-filtered 502, but this process step is optional. An envelope detection is performed 504 (amplitude or power). That signal may be post-filtered 506, but that is also optional. An exponential growth detection is performed 508. If the exponential growth is sustained for K samples 510 then the next test is whether the consecutive exponential growth measurements are within the same growth rate 512. If so, then if the exponential growth rate is deemed to be related to power then the output is a positive detection of early audio feedback 520. If any of the last three tests are negative, the detector is reset 530. Therefore, by avoiding inconsistent growth patterns, false detections can be reduced. It is understood that in various embodiments, the consistency checking may include different tests. In some embodiments, the consistency checks may be optional. Thus, the consistency checking may be more or less than what is stated here and may vary per application and/or condition without departing from the scope of the present subject matter.

Exponential growth pattern patching can be used to identify early acoustic feedback. It should be positive for a minimum period of time (or number of samples) in order to validate a positive detection. Consecutive exponential growth measurements should be around the same growth range, showing that the exponential growth is consistent, and belonging to the same exponential growth process. In other words, if measured with a log scale, consecutive exponential growth measurements should display similar or approximate slope values (within certain tolerance range). The exponential growth rate can be compared against the ratio of output signal power over input signal power (power gain ratio) in order to further validate that the exponential growth is related to the system gain.

The algorithm can be implemented in the digital domain as well as the analog domain. The algorithm can be implemented in the time domain as well as the frequency domain. The algorithm can use the amplitude envelope or power envelope to detect exponential growth Different tests may be performed at different signal sources in the hearing assistance devices. It is understood that the parameters used and the exact order may vary without departing from the scope of the present teachings.

Therefore, it is desirable to have a system that can detect the early acoustic feedback situation and trigger an action as fast as possible, such that this short burst of non-compensated feedback artifact can be promptly minimized. The feedback detector should be fast enough so that it can trigger an action before the feedback oscillation becomes audible. In other words, this feedback detector should be able to detect feedback on its very early stage, even before it becomes an oscillation. This feedback detector should be robust and accurate, so that cases of false detections and missed detections are minimized.

This new method uses the exponential growth nature of the feedback process in order to differentiate it from other sources of sound signal. This new method flags a positive detection if the signal can match the model of a persistent exponential growth power envelope. It uses a unique characteristic of the feedback process, that is not present in natural sounds (environment, speech), not even in man created sounds (music, machine sounds).

Once feedback build up is detected by this new process, even before it becomes an established oscillation, there are several methods that can be used to attenuate/eliminate temporary feedback leakage while the adaptive filter catches up the new acoustic leakage path, including but not limited to:

- Switching immediately to new filter coefficients that might be more adequate to the new feedback path;
- Increasing adaptation rate, such that the filter can adapt faster;
- Gain reduction, such that there is not enough gain to generate feedback during adaptation to the new path;
- Use of notch filters for the frequencies of interest;
- Use of any other form of accessory filtering (ex. combination of time domain and frequency domain filters);
- Use of output phase shifting (one such technique is called output phase modulation or OPM, which provides adjustable phase shift including, but not limited to the disclosure described in copending, commonly owned patent applications U.S. patent application Ser. No. 11/276,763, filed Mar. 13, 2006, titled OUTPUT PHASE MODULATION ENTRAINMENT CONTAINMENT FOR DIGITAL FILTERS and U.S. patent application Ser. No. 12/336,460, filed Dec. 16, 2008, titled OUTPUT PHASE MODULATION ENTRAINMENT CONTAINMENT FOR DIGITAL FILTERS, that are both hereby incorporated by reference in their entirety);
- Triggering of any other feedback control/management method that can be used to control/attenuate/eliminate feedback;

The present method can be combined to other distinctive feedback transition features such as size of adaptation increments, such that robustness and reliability can be further improved.

The following transfer function for a feedback loop having forward gain K and reverse gain B is used to derive the equation for early acoustic feedback detection:

$$H = \frac{K(\omega)}{1 - K(\omega)B(\omega)}$$

The Open Loop Gain:

$$K(\omega)B(\omega)$$

The oscillation condition provides that it can happen for any frequency ω, where:

$$|K(\omega)B(\omega)| \geq 1$$

And $$\angle K(\omega)B(\omega) = 0°$$

Considering a certain frequency $\omega_{fb}$ and mic>>IN (the input)

$$G = K(\omega_{fb})B(\omega_{fb})$$

$$fbk(t) = G^{*}\mathrm{mic}(t-\Delta t) = G^{*}fbk(t-\Delta t)$$

If we choose Δt to be τ, the time it takes for fbk to increase by a factor of G, then:

$$fbk(t) = G^{t/\tau}$$

Which represents an exponential growth because G>1 (feedback oscillation condition) and τ>0

One aspect of the present algorithm is to detect a growth in amplitude pattern that follows the exponential curve described above. Notice that it is not any exponential curve, but the one which growth factor G is defined by the open loop gain K(ω)*B(ω)

```
Pseudocode:
Given a signal X
  Set a threshold value Th related to the open loop gain
Set a tolerance value ϵ
  IF amplitude of X > minimum amplitude to enable detection
    IF LOG(X(t)) − LOG(X(t-1)) > Th − ϵ
      IF LOG(X(t)) − LOG(X(t-1)) < Th + ϵ
        INCREMENT DETECTION COUNTER
      ELSE
```

-continued

```
RESET DETECTION COUNTER
RESET DETECTION COUNTER
RESET DETECTION COUNTER
IF DETECTION COUNTER > minimum number of counts
FLAG POSITIVE DETECTION
```

Certain measures have been shown to provide more effective acoustic feedback cancellation using the present system. For example, if an early acoustic feedback is detected, by performing gain reduction in a band for a short time and at about substantially the same time doubling the speed of the feedback canceller for a slightly longer time has shown to provide excellent feedback cancellation. For example, once an early acoustic feedback event is detected, the system reduces gain in the affected band(s) for about ½ second and at substantially the same time doubles the speed of the feedback canceller for about a second to perform better cancellation of the early acoustic feedback event.

Another approach that has shown to be particularly effective is to apply gain reduction to bands on either side of an affected band. For example, a notch filter is made by reducing gain in band X and also in bands X−1 and X+1.

For speech applications where a voice activated detector (VAD) is available it is has been demonstrated that when speech is present it can be beneficial to be less aggressive with the gain reduction. For example, when speech is present and an early acoustic feedback event is detected in band X, rather than setting the gain reduction in bands X−1, X, and X+1 to 0 dB, −12 dB, and 0 dB, respectively, it has been shown that using 0 dB, −6 dB, and 0 dB or using −6 dB, −12 dB, and −6 dB provides less speech distortion. Thus, when speech is present, a more gradual gain reduction can be beneficial.

In various embodiments, the envelope detector can include a smoothing filter with a time constant that can be adjusted to capture the most appropriate signal envelope. The envelope detector in various embodiments may be a simple rectifier, a squaring and low pass filter, an absolute value and low pass filter, a Hilbert transform or any other method, circuit or algorithm that can be used to detect either the amplitude or power envelope.

The algorithm might also include empirical mode decomposition, wavelet decomposition or any other method that can be used to further refine the envelope calculation.

It is understood that digital signal processing implementations of the present subject matter can be accomplished by the DSP and that the functions are performed as a result of firmware that programs the DSP accordingly. It is possible that some aspects may be performed by other hardware, software, and/or firmware. Consequently, the system set forth herein is highly configurable and programmable and may be used in a variety of implementations.

The present subject matter can be used for a variety of hearing assistance devices including, but not limited to tinnitus masking devices, assistive listening devices (ALDs), cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, such as receiver-in-the-canal (RIC) or receiver-in-the-ear (RITE) designs. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device, comprising:

a microphone;

a receiver; and a processor connected to the microphone and receiver, the processor configured to receive signals from the microphone and process the signals according to a plurality of processing blocks, the processor adapted to include an early acoustic feedback event detector that can provide detection of a programmable number of consecutive exponential increases in the power of the signals using a logarithmic function to detect and correct for early acoustic feedback.

2. The device of claim 1, wherein the early acoustic feedback event detector includes a programmable threshold.

3. The device of claim 2, wherein the early acoustic feedback event detector includes a programmable amount of time the threshold is exceeded before an exponential increase in power of the signals is detected.

4. The device of claim 1, wherein the processor is further adapted to include a feedback attenuation control, and wherein an output of the feedback event detector is provided to the feedback attenuation control.

5. The device of claim 4, wherein the feedback attenuation control is configured to correct for early acoustic feedback.

6. The device of claim 1, wherein the early acoustic feedback event detector includes an envelope detector.

7. The device of claim 6, wherein the envelope detector includes a smoothing filter with an adjustable time constant.

8. The device of claim 6, wherein the envelope detector includes a simple rectifier, a squaring and low pass filter, an absolute value and low pass filter or a Hilbert transform.

9. The device of claim 1, wherein the early acoustic feedback event detector includes exponential growth pattern patching.

10. A method, comprising:

receiving signals from a hearing assistance device microphone; and detecting a predetermined number of consecutive exponential increases in power of the signals using a logarithmic function to detect early acoustic feedback, wherein the predetermined number is programmable.

11. The method of claim 10, wherein detecting a predetermined number of consecutive exponential increases in the power of the signals includes using a sub-band domain implementation.

12. The method of claim 10, wherein detecting a predetermined number of consecutive exponential increases in the power of the signals includes using a frequency domain implementation.

13. The method of claim 10, wherein detecting a predetermined number of consecutive exponential increases in the power of the signals includes using a time domain implementation.

14. The method of claim 10, further comprising correcting for early acoustic feedback.

15. The method of claim 14, wherein correcting for early acoustic feedback includes changing filter coefficients.

16. The method of claim 14, wherein correcting for early acoustic feedback includes increasing an adaptation rate.

17. The method of claim 14, wherein correcting for early acoustic feedback includes reducing gain.

18. The method of claim 14, wherein correcting for early acoustic feedback includes using notch filters for frequencies of interest.

19. The method of claim 14, wherein correcting for early acoustic feedback includes using a combination of time domain and frequency domain filters.

20. The method of claim 14, wherein correcting for early acoustic feedback includes using output phase shifting.

* * * * *